United States Patent [19]

Zaoui

[11] 3,936,886

[45] Feb. 10, 1976

[54] TROUSERS

[76] Inventor: Raymond Zaoui, 17 rue Le Vau, Paris, France

[22] Filed: June 3, 1974

[21] Appl. No.: 475,989

[30] Foreign Application Priority Data

Oct. 19, 1973 France ..... 73/37371

[52] U.S. Cl. ..... 2/227

[51] Int. Cl.[2] ..... A41D 1/06

[58] Field of Search ..... 2/227, 228, 234, 238, 78 R, 2/79

[56] References Cited

UNITED STATES PATENTS

| | | | |
|---|---|---|---|
| 254,092 | 2/1882 | Frank et al. | 2/227 |
| 281,790 | 7/1883 | Pearson | 2/227 |
| 478,190 | 7/1892 | Hamilton et al. | 2/227 |
| 478,195 | 7/1892 | Lewis et al. | 2/227 |
| 478,281 | 7/1882 | Hamilton et al. | 2/227 |
| 707,556 | 8/1902 | Dane | 2/227 |
| 2,079,398 | 5/1937 | Dean | 2/227 |

*Primary Examiner*—H. Hampton Hunter
*Attorney, Agent, or Firm*—Hill, Gross, Simpson, Van Santen, Steadman, Chiara & Simpson

[57] ABSTRACT

To facilitate forming the inside seams of trouser legs, the trouser back panels are made with the so-called bottom or fork point projecting only slightly and with a fairly pronounced convexity in the upper region of their outer longitudinal edges. Increasing the prominence of the lower point of the fly slit on the front panels leads to a further improvement.

4 Claims, 9 Drawing Figures

23
22
21
28
27
25
26
29
24
39
-20-

33
32
31
35
36
38
34
37
39
-30-

23
33
32
22
20
31
21
28,37
26
36
38
29
34
24

42
43
-40-
48
47
45
46
49
44

52
53
51
57
-50-
55
56
58
54

52
42
41,51
48,57
53
43
45
46,56
49,58
44,54

TROUSERS

The present invention concerns trousers and their method of manufacture.

It is known that a pair of trousers comprises two sections which are substantially symmetrical in relation to a longitudinal median plane, each section being formed by a front and back panel joined together along lateral seam lines, one external and the other internal, to form a leg of the said trousers and a half of the so-called "culotte" of the latter, the said sections also being joined together along the said longitudinal median plane to complete the culotte.

In known manner in a front panel, the outside longitudinal edge, corresponding to the outside lateral seam line, is continuous and substantially straight, having only a slight convexity in its upper part, whilst the inside longitudinal edge of such a panel, corresponding to the inside lateral seam line, has in its upper section a substantially transverse cut-out part, the so-called fly slit, of which the lower point projects in relation to the upper point and is connected to the lower section of the said front panel along a slightly concave edge.

Similarly, in a back panel of known type, the outside longitudinal edge, corresponding to the outside lateral seam line, is continuous and substantially straight having only a slight convexity in its upper section. The inside longitudinal edge of a back panel has in its upper section a large cut-out part beginning at one end at the waist and ending at the other end in a point, the so-called fork or bottom point, which projects prominently and is connected to the lower section of the back panel along a significantly concave edge. Generally, a back panel is wider than a front panel.

Thus joining a front panel and a back panel together along the outside seam line does not present undue difficulties, since the edges of these panels are very similar. On the other hand, the joining of these panels to form the inside seam line is very awkward because it is necessary to sew a slightly concave line (that which proceeds from the lower point of the fly) to a markedly concave line (that which is below the bottom point of the back panel) i.e. lines which are of different lengths. This results in the formation of a bulge which subsequently has to be shrunk by ironing.

However, shrinkage by ironing is not always possible. It depends on the nature of the fabric from which the trousers are made. For example, with synthetic fabrics such as "Tergal" and cotton fabrics in particular, any shrinkage by ironing is ruled out. Trousers made of these materials therefore have bulges which lead to the trousers "hanging" badly and therefore detract from their appearance.

It is an object of the present invention to solve these problems, and to provide trousers in which the formation of the bulges mentioned above is largely avoided.

To this end, in accordance with the invention the pair of trousers is distinguished in that in each of its back panels the bottom point of the cut-out upper section of the inside edge projects relatively slightly, whilst a fairly pronounced convexity of adequate proportions is provided in the upper section of the outside edge.

In trousers according to the invention, the line connecting the bottom point to the lower section of the back panel is less concave than hitherto, thus allowing the formation of the undesirable bulges to be avoided.

To improve matters still further, the or, preferably, each front panel of trousers according to the invention may be such that the lower point of the fly is more pronounced than in known trousers. In this way, the concave lines to be joined may be made more similar to one another.

Advantageously, the arrangement is such that the inside longitudinal edges of a front panel and back panel which correspond to one another may be superposed exactly between the bottom of the panels and the lower point of the fly slit or the bottom point, respectively.

Similarly, it is advantageous for the outside longitudinal edges of such panels to be exactly superposable between the base of the said panels and the onset of the pronounced concavity of the back panel.

Thus, with the trousers according to the invention, the seam from the fork to the heel is further inside in relation to the leg and becomes invisible. The balance of such a pair of trousers is better than heretofore obtained and its creases may be disposed exactly in the median longitudinal plane of the trousers. Furthermore, each leg may be ironed once in comparison with twice for known trousers, which greatly simplifies pressing.

Trousers according to the invention will now be described, by way of example, with reference to the accompanying drawings, in which.

Figure 1:
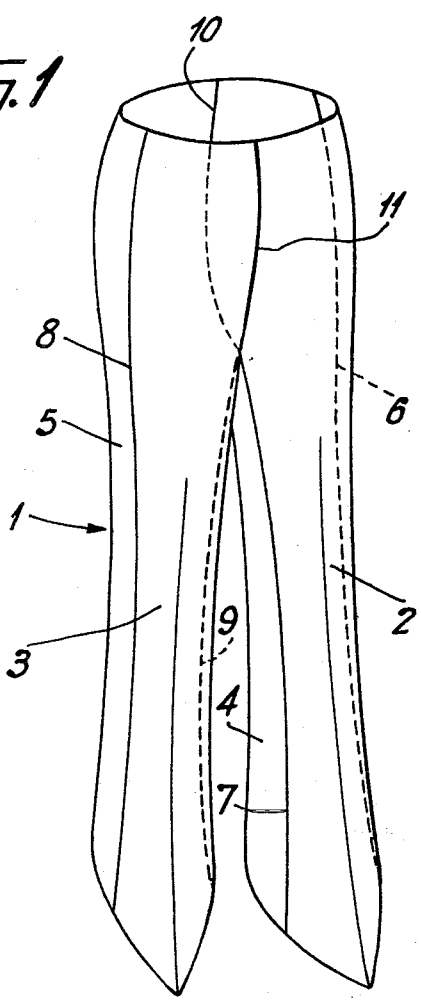
FIG. 1 shows a schematic perspective view of a pair of trousers, and is intended to illustrate the general principles applicable.

Referring to FIG. 1, the trousers indicated generally by the reference numeral 1 are formed in known manner by joining together four longitudinal panels: two front panels 2 and 3 and two back panels 4 and 5. The front panel 2 and back panel 4 are joined along the outside lateral seam line 6 and along the inside lateral seam line 7. In the same manner, the front panel 3 and back panel 5 are joined together along the outside lateral seam line 8 and along the inside lateral seam line 9. Finally, the back panels 4 and 5 are joined together along the rear seam line 10, whilst the front panels 2 and 3 are joined either by a front seam or by a fly 11.

Figures 2, 3, 4:
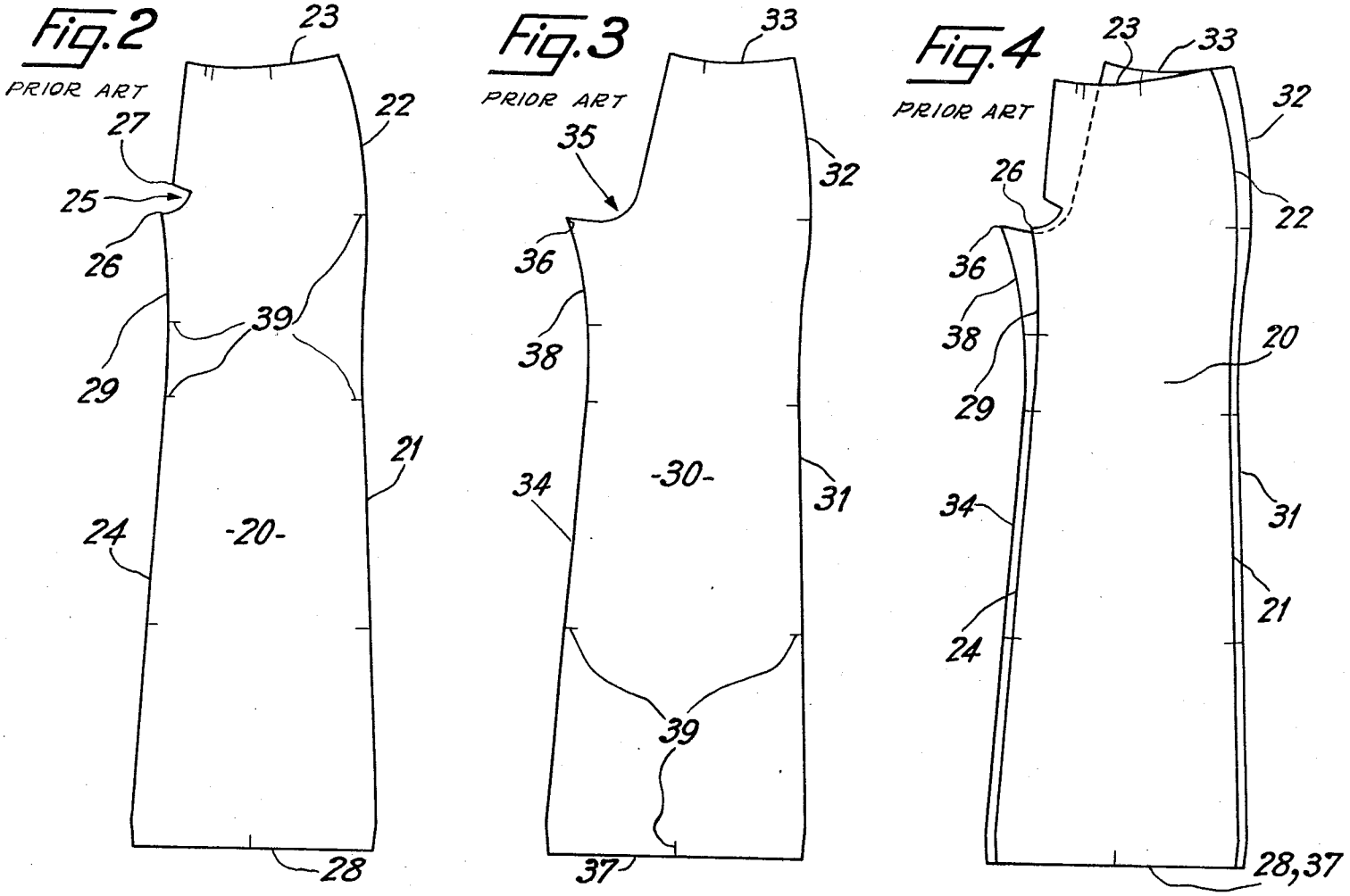
Fig. 2 PRIOR ART
Fig. 3 PRIOR ART
Fig. 4 PRIOR ART
FIG. 2 shows the pattern of a front panel for a pair of trousers of known type.
FIG. 3 shows the pattern of a back panel for a pair of trousers of known type.
FIG. 4 shows the front pattern of FIG. 2 superposed on the back pattern of FIG. 3.

The pattern 20 for the known front panel shown in FIG. 2 has a continuous outside longitudinal edge 21 (corresponding to the outside lateral seam line 6 or 8), which is substantially straight and has only a slight convexity 22 in its upper section with respect to the waist edge 23. The inside longitudinal edge 24 of the pattern 20 (which corresponds to the inside lateral seam line 7 or 9) has in its upper section a fly slit 25, of which the lower point 26 projects beyond the upper point 27, and is connected to the lower section of the said pattern (with respect to the base 28) along a slightly concave line 29.

The pattern 30 for the known back panel shown in FIG. 3 has a continuous outside longitudinal edge 31 (corresponding to the outside lateral seam line 6 or 8) which is substantially straight and has only a slight convexity 32 in its upper section, with respect to the waist edge 33. The inside longitudinal edge 34 of the pattern 30 (which corresponds to the inside lateral seam line 7 or 9) has in its upper section a large cut-out part 35 proceeding from the waist 33 and ending at a bottom point 36, which projects prominently and is connected to the lower section of the said pattern 30 (with respect to the base 37) along a significantly concave line 38.

The patterns 20 and 30 have various reference marks 39, which when brought into coincidence allow one of the patterns to be centred in relation to the other (see FIG. 4) in a position which corresponds to the seam position of the panels obtained from the said patterns. As shown in FIG. 4, the back pattern 30 is generally wider than the front pattern 20.

It can be seen that the joining together of the panels obtained from the patterns 20 and 30 does not present any difficulties on the outside seam lines 6, 8 because on that side the outside longitudinal edges 21 and 31 are very similar in shape and dimensions. On the other hand, joining the panels 20 and 30 together along an inside seam line 7 or 9 is very difficult because it is then necessary to join together the edges 24 and 34 which have at 29 and 38, respectively, concave lines of different lengths. The disadvantages of this state of affairs has been described above.

Figure 8:
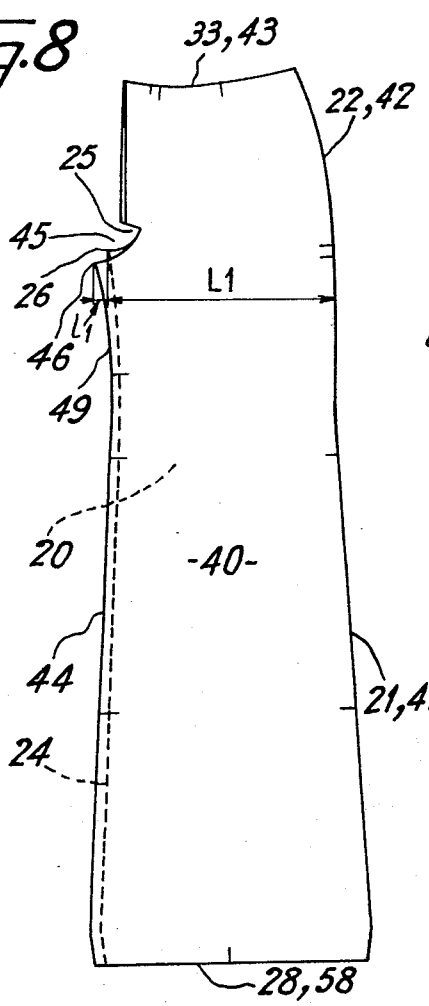
FIG. 8 shows the front pattern of FIG. 5 superposed on the front pattern of FIG. 2.
Figures 5, 6, 7:
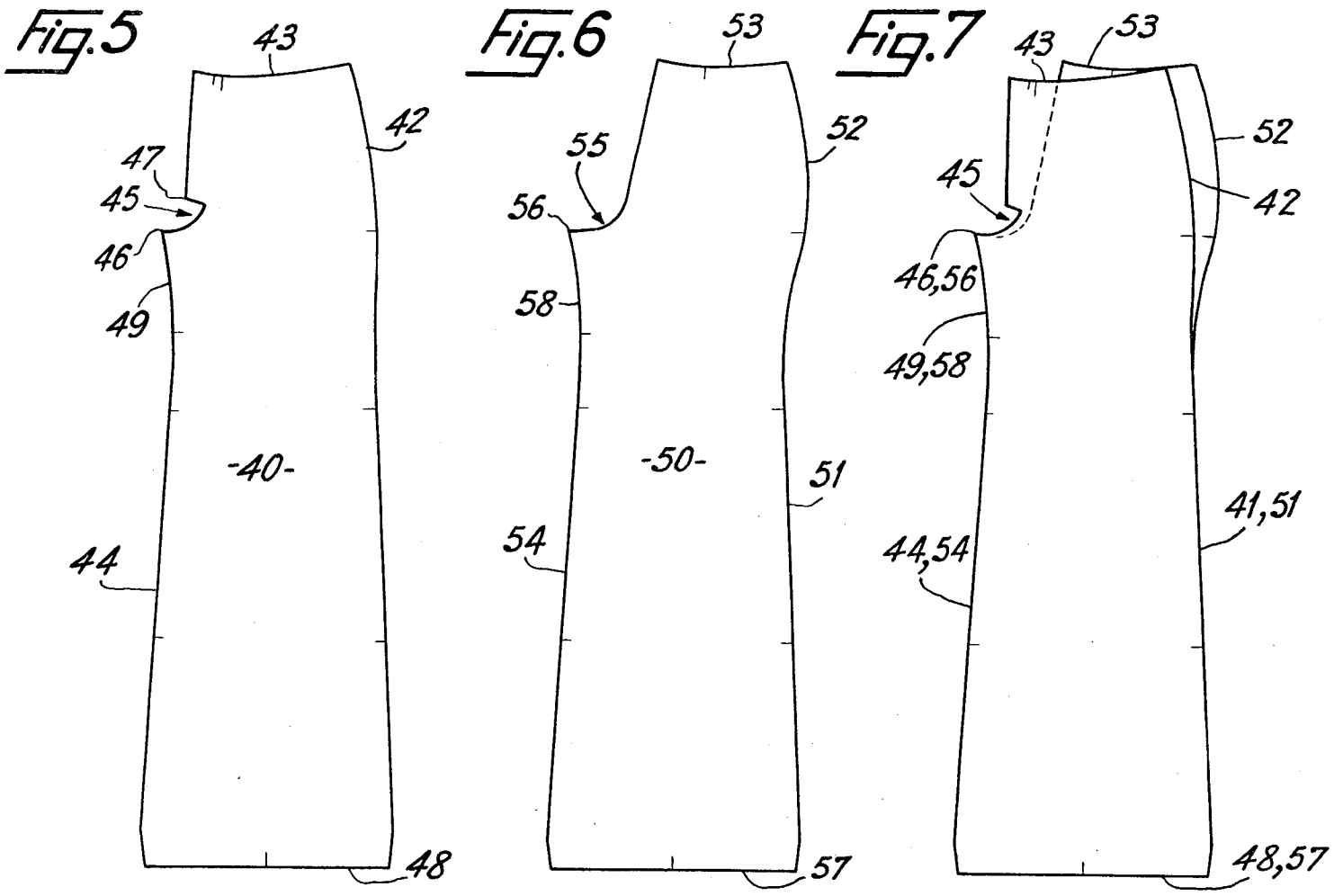
FIG. 5 shows the pattern of a front panel for a pair of trousers according to the invention.
FIG. 6 shows the pattern of a back panel for a pair of trousers according to the invention.
FIG. 7 shows the front pattern of FIG. 5 superposed on the back pattern of FIG. 6.

The pattern 40 for the front panel according to the invention, shown in FIG. 5, has an outside longitudinal edge 41 similar to that of the pattern 20 of FIG. 2 (as can be seen from the superposition represented in FIG. 8), with a slight convexity 42 in its upper section, with respect to the waist edge 43. The inside longitudinal edge 44 of the pattern 40 has, in its upper section, a fly slit 45, of which the lower point 46 projects beyond the upper point 47 and is connected to the lower section of the said pattern (with respect to the base 48) along a concave line 49. As shown in FIG. 8, the point 46 of the fly slit 45 is more pronounced than the point 26, the pattern 40 therefore being slightly wider than the pattern 20.

If $L_1$ is the width of pattern 20 at the level of point 26 and $l_1$ the projection of point 46 relatively to point 26 (see FIG. 8), according to the invention, the ratio $(l_1/L_1)$ may be comprised between 5 and 15%.

Figure 9:
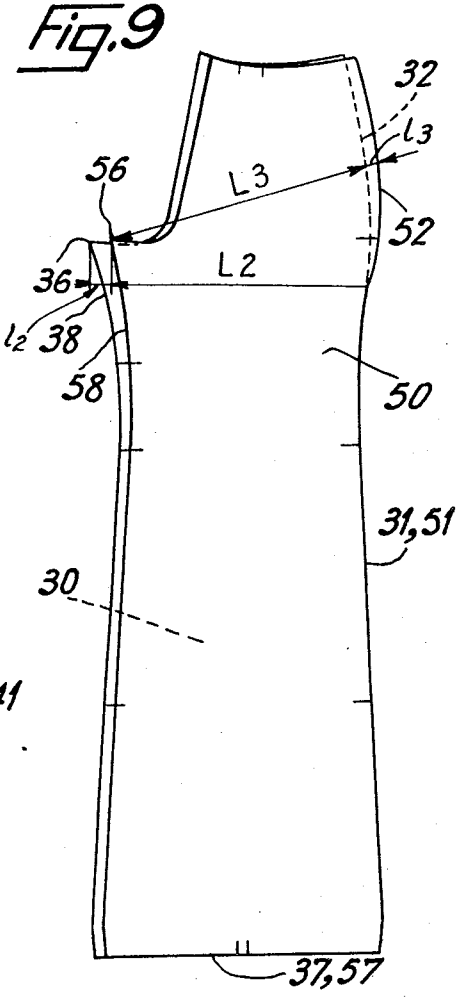
FIG. 9 shows the back pattern of FIG. 6 superposed on the back pattern of FIG. 3.

The pattern 50 for the back panel according to the invention shown in FIG. 6 has an outside longitudinal edge 51 essentially similar to the edges 31 or 41 of the patterns 30 and 40 respectively (see FIGS. 7 and 9). However, instead of the slight convexities 32 or 42, the pattern 50 has a marked convexity in the region 52. The inside longitudinal edge 54 of the pattern 50 has in its upper section a cut-out part 55 proceeding from the waist edge 53 and ending in a bottom point 56 which projects slightly but in any case less than the bottom point 36. The bottom point 56 is connected to the lower section of the pattern 50 (with respect to the base 57) along a line 58 not so significantly concave as the line 38.

If $L_2$ is the width of pattern 50 at the level of point 56 and $l_2$ the projection of point 36 relatively to point 56, according to the invention the ratio $(l_2/L_2)$ may be comprised between 5 and 15% (see FIG. 9). Furthermore, the ratio of the distance $L_3$ between the point 56 and the median portion of convexity 32, and of the projection $l_3$ of convexity 52 relatively to convexity 32 in this median portion may be comprised between 5 and 15%.

FIG. 7 shows that the edges 44 and 54 may be superposed between the points 46 and 56 and the bases 48 and 57, whilst the edges 41 and 51 may likewise be superposed with the exception of the convexity 52 which projects prominently.

FIG. 9 shows that the pattern 30 is wider than the pattern 50, and that the edges 31 and 51 may be superposed with the exception of the convexity 52.

Trousers according to the invention have an appearance far superior that of known trousers and are much easier to make and iron.

It will be appreciated that the convexity provided in the upper section of the outside edge of the back panel of trousers according to the invention is relatively more pronounced than is the case in known trousers. This increased prominence is determined at least to some extent by the relatively decreased prominence of the bottom point.

As can be seen from the comparative dimensions illustrated in FIGS. 8 and 9 of the accompanying drawings, the extent to which the panels of trousers in accordance with the invention may differ from the conventionally shaped panels of known trousers, in terms of the increased convexity in the back panel, increased prominence of the lower point of the fly slit in the front panel, and decreased prominence of the bottom point in the back panel, may typically vary between 5 and 15%.

I claim:

1. Trousers adapted to prevent twisting of the trouser legs and prevent bulges near the lower point of the fly, comprising:

a. front panels and back panels, each of said front and back panels formed by an inside longitudinal edge, a waist edge, an outside longitudinal edge, and a panel base at the bottom of the trouser leg;

b. said front panel inside edge having a fly slit below the waist edge and a lower point of said fly slit;

c. said front panel outside edge having a convexity below said waist edge;

d. said back panel inside edge having a bottom point below said waist edge;

e. said back panel outside edge having a convexity below said waist edge;

f. a relationship between the inside and outside longitudinal edges of said front and back panels such that when superimposed upon one another, said front and back panel bases exactly superimpose, the inside edge of the back panel between the bottom point and panel base exactly superimposes with the inside edge of the front panel between the lower point and panel base, the outside edge of the back panel between the back panel convexity and panel base, exactly superimposes with the outside edge of the front panel between the front panel convexity and panel base, and the back panel convexity projects beyond the front panel convexity; and g. inside lateral seam lines being formed by a connection of said front and back panel inside edges, and outside lateral seam lines being formed by a connection of said front and back panel outside edges.

2. The trousers of claim 1 in which said back panel bottom point projects at least 5 percent less than a bottom point (36) in a prior art trouser back panel in FIG. 3.

3. The trousers of claim 1 in which said front panel lower point projects at least 5 percent beyond a lower point (26) in a prior art trouser panel illustrated in FIG.

2.

4. The trousers of claim 1 in which said back panel convexity projects at least 5 percent beyond a back panel convexity (32) in a prior art back panel illustrated in FIG. 3.

* * * * *